US006309159B1

(12) United States Patent
Weaver et al.

(10) Patent No.: US 6,309,159 B1
(45) Date of Patent: Oct. 30, 2001

(54) SELF DRILLING ROOF BOLT

(75) Inventors: Steven Lee Weaver, Maryland; Michael Andrew McLean, Hamilton East; Eric Ivan Johnson, Warners Bay, all of (AU)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/698,016

(22) Filed: Oct. 30, 2000

(30) Foreign Application Priority Data

Oct. 29, 1999 (AU) ..... 57122/99

(51) Int. Cl.[7] ..... F16B 25/00; E21D 20/00

(52) U.S. Cl. ..... 411/387.5; 411/387.1; 411/395; 405/259.1

(58) Field of Search ..... 411/387.1, 387.2, 411/387.3, 387.4, 387.5, 387.6, 387.7, 387.8, 395; 405/259.1, 259.5, 259.6

(56) References Cited

U.S. PATENT DOCUMENTS 3,085,453 * 4/1963 Mossberg ..... 411/387.5 X
5,098,435 * 3/1992 Stednitz et al. ..... 411/387.5 X
5,803,671 9/1998 Gray .
6,004,085 * 12/1999 Yamamoto et al. ..... 411/387.5 X

FOREIGN PATENT DOCUMENTS 672428 9/1993 (AU) .

* cited by examiner

*Primary Examiner*—Nelli Wilson
(74) *Attorney, Agent, or Firm*—Burns, Doane, Swecker & Mathis, L.L.P.

(57) ABSTRACT

An elongate roof bolt includes a bolt body having an axially extending central bore and defining a leading end. The leading end includes a pair of axially extending abutment elements formed by machining. Each abutment element includes an abutment face for engagement with a drill tip on opposite sides thereof, to transmit rotary forces during drilling. The drill tip extends across the leading end of the bolt body and is bonded to the abutment elements by welding, soldering or brazing. The bore opens out of said bolt bonded adjacent said leading end.

15 Claims, 4 Drawing Sheets

SELF DRILLING ROOF BOLT

BACKGROUND OF THE INVENTION

The present invention relates to a bolt of the type which is commonly known as rock bolt or a roof bolt and in particular, the invention relates to a self-drilling roof bolt.

Roof bolts are commonly employed in the underground mining industry to support the walls of rock excavations against fragmentation or collapse. The normal procedure for installing a roof bolt involves drilling a pilot hole into the rock wall and inserting the bolt therein. The bolt is fixed within the bole normally by a settable glue, such as a resin or mortar cement, or the bolt may include means to directly interlock with the surface of the pilot hole, such as a thread or an expanding sleeve. A wide variety of roof bolts exist and one particular form is tubular, having a central bore formed lengthwise through the bolt. Advantageously, the central bore provides a conduit for the introduction of water during insertion of the bolt into the pilot hole. Water is employed to flush away rock segments, finings and dust, and to reduce frictional resistance between the bolt and the rock, and excessive temperature generation. The central bore also provides a conduit for the injection of cement mortar or resin into the pilot opening to secure the bolt therein.

The above described methods of installing a roof bolt thus employ a two stage process, in which the pilot hole is first drilled, after which the roof bolt is inserted into the pilot hole and secured therein by the appropriate means. This type of roof bolt therefore has no drilling capability. Roof bolts having a drilling capability, and thereby referred to as "self-drilling roof bolts", are known, but such bolts are not in common use in the mining industry. This is despite such roof bolts requiring fewer installation steps when compared to roof bolts of the earlier described kind, because a separate drill to form the pilot hole is not required. Thus, the self-drilling type of roof bolt can be installed more quickly, thereby reducing the period in which the excavated rock face may be unstable and likely to fragment or collapse.

Self-drilling roof bolts have not become popular, and one reason for this is because the bolt must be modified to include a reaming or drilling bit at the leading end thereof in order to enable the bolt to drill the pilot hole and that increases considerably the cost of the bolt. Such bits are expensive because they are normally subject to very high wear, given the abrasive material they are required to penetrate and thus, it is normal for the drift bit of the bolt to be hardened, and that is normally facilitated by the provision of a tungsten carbide tip. In one particular form of tubular roof bolt, described in Australian Patent No. 672,428, the roof bolt is formed by rolling or die drawing a pair of elongate members into half cylindrical sections, and connecting them along their longitudinal edges by welding to form a bolt rod. In this form of roof bolt, the central bore adjacent the leading end thereof is threaded, to accept the threaded shark of a tungsten carbide rotary drill bit. Rotary drill bits are well known and the assignee of the current invention makes a range of such bits which include a steel body supporting the tungsten carbide tip, which is brazed thereto. These bits however, are relatively expensive when compared to the rod they are connected to. In each of the above described roof bolts, the addition of the tungsten carbide bit to the leading end of the rock bolt, involves sufficient expense to make general use of a roof bolt formed in this manner, prohibitive. However, it nevertheless remains the case, that the installation advantages of a self-drilling roof bolt outweigh those of the non-self-drilling type.

It is an object of the present invention to provide a self-drilling roof bolt which is less costly to manufacture than roof bolts of that kind described above and so to make their use in the mining industry more attractive.

SUMMARY OF THE INVENTION

According to the invention there is provided an elongate roof bolt having an axially extending central bore and defining a leading end at one end thereof, said leading end including a pair of axially extending abutment elements formed by machining. Each abutment element includes an abutment face for engagement with a drill tip on opposite sides thereof, to support the drill tip during drilling. The drill tip extends across said leading end and is secured to the abutment elements by welding, soldering or brazing. The bore opens through said bolt at or adjacent said leading end.

In a first aspect of the invention, the arrangement is such that the central bore remains open at or adjacent the leading end of the rod when the drill tip is connected thereto. The roof bolt of the invention thus maintains the advantages of a centrally bored bolt, but additionally provides for self-drilling with associated advantages, without requiring attachment of a complete drill bit. The invention thus eliminates the need for separate roof bits and drill rods.

The drill tip is preferably of planar form and extends diametrically across the leading end of the rod across the open end of the central bore. The abutment elements are spaced apart on opposite sides of the central bore, and the thickness of the drill tip is less than the diameter of the central bore, so that the bore is open on either side of the drill tip. This permits an increase in the pumping speed of the glue used to secure the bolt in the hole drilled by the rod, as well as the rate of flushing during drilling, compared to an arrangement having the hole covered (but not closed) by the drill tip, In a second aspect of the invention, the drill tip extends across and covers the opening of the central bore at the leading end of the rod. In this arrangement, branching conduits extend from the central bore and open through the side wall surface of the rod, adjacent the leading end. A single branching conduit may be provided, although it is preferable to have at least two such conduits opening into opposite sides of the rod.

The branching conduits may extend laterally to the central bore, or at an angle to the central bore. Moreover, the branching conduits may have any suitable cross-section but preferably will be circular and have a diameter which is either the same as, or greater or larger than that of the central bore.

The above arrangement of branching conduits may equally be applied to the first aspect of the invention described above. That is, the roof bolt may have the central bore open at the leading edge thereof, but may also employ branching conduits extending to sidewall surfaces. Such an arrangement may promote greater pumping and flushing speeds, compared to an arrangement that does not include the branching conduits.

In a roof bolt according to the invention, the drill tip extends across the central bore and preferably extends beyond the outer periphery of the rod, Alternatively, the opposite ends of the drill tip may terminate within the outer periphery of the rod, or extend to or adjacent the outer periphery.

In the above arrangements the drill tip is also supported axially against the leading end of the bolt and preferably that support is provided against a base surface of the drill tip located adjacent to the leading end of the bolt and preferably the axial support is provided on either side of the central bore. The axial support of a base surface of the drill tip may extend between an edge of the central bore and an outer edge of the bolt and a planar surface may be machined for that purpose. The machined surface may be a platform distinct from other surface sections of the leading end.

Fixed connection of the drill tip to the bolt can be achieved by bonding in any suitable manner and for example, a tungsten carbide tip may be fixed by brazing. Welding may be possible with other types of tip material. The drill tip can be fixed to any suitable part of the leading and of the bolt and preferably is fixed to both the abutment elements and the axial supporting surface.

The rod of the roof bolt may be formed in any suitable manner and may for example be formed with a continuous or discontinuous thread extending along its length. Longitudinal flat sections may be located on opposite sides of the rod. If a thread and/or flat sections are provided, they may extend the fall length of the rod, or may extend only over a section or sections of the rod. In one embodiment, the thread is terminated prior to the leading end of the rod.

It is preferred that the leading end of the rod is formed to provide clearance behind the drill tip in the normal direction of rotation of the bolt. Thus, each of the abutment elements may be formed to extend axially to support substantially the full height of the rear face of the drill tip, but to slope axially downwardly away from the rear face to provide the desirable clearance. The leading end may also be formed to provide clearance in front of the oppositely facing cutting edges of the drill tip. That frontal clearance may extend from a radial outer edge of the drill tip inwardly to the other of the abutment elements supporting the opposite side or trailing face of the drill tip. The frontal clearance may vary in depth and in one form of the invention a curved or scalloped profile is applied which extends from a minimum depth adjacent the radial edge, to a maximum depth approximately adjacent the midsection of the drill tip. It is preferred that the frontal clearance be of a continuous smooth curve, in order to minimize stress concentration, although it is nevertheless possible to provide frontal clearance by two or more curved sections, or by adjacent curved and straight sections.

The profile of the frontal clearance may enlarge the opening of the central bore axially to facilitate increased flushing and glue pumping speed. The opening of the central bore can be so enlarged on either side of the drill tip by applying the same frontal clearance profile on either side thereof.

BRIEF DESCRIPTION OF THE DRAWINGS

The objects and advantages of the invention will become apparent from the following detailed description of preferred embodiments thereof in connection with the accompanying drawing, in which like numerals designate like elements, and in which.

DETAILED DESCRIPTION OF PREFERRED EMBODIMENTS OF THE INVENTION

Figure 1:
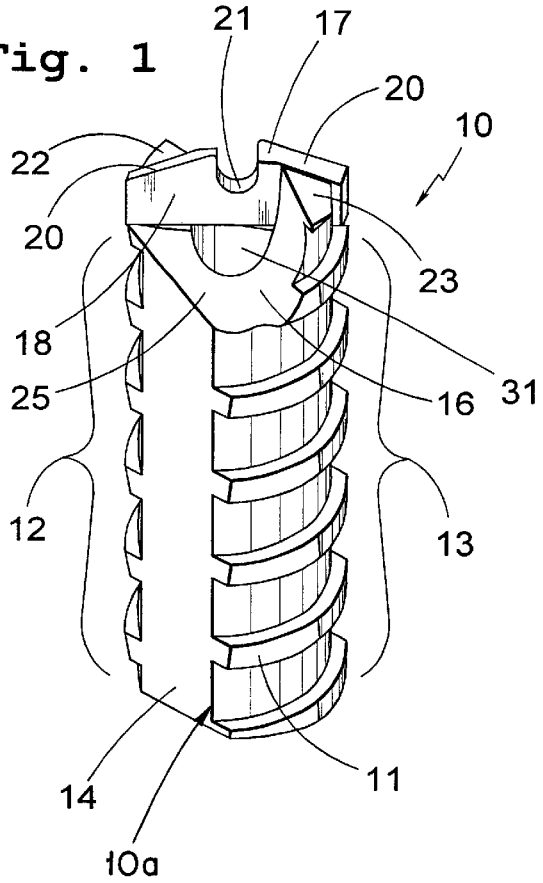
FIG. 1 is a front perspective view of a roof bolt according to the invention.

The bolt 10 includes a body 10*a* constructed in any suitable manner to define a central bore, and the previously described methods of rolling or die drawing to achieve this are each appropriate, but other suitable methods could be used as well.

The bolt body 10*a* is formed with a discontinuous thread profile, comprising a thread 11, separated into opposite threaded rod portions 12 and 13 by a pair of oppositely located longitudinally extending flats 14 and 15. This type of rod profile is shown in Australian Patent No. 672,428, although it should be appreciated that other rod profiles are equally within the scope of the present invention.

The bolt body 10*a* has a leading or front end 16 which is machined to accept for correction thereto, a drill tip 17, such as a tungsten carbide drill tip of a known form. The drill tip 17 is of planar form defining a pair of opposite planar faces 18 and 19 and having a pair of inclined cutting edges 20 depending from a central channel or recess 21. The cutting edges 20 are formed according to known principles and a roof bolt formed in the manner shown is operative as a rotary drill and not as a percussive drill.

Figure 4:
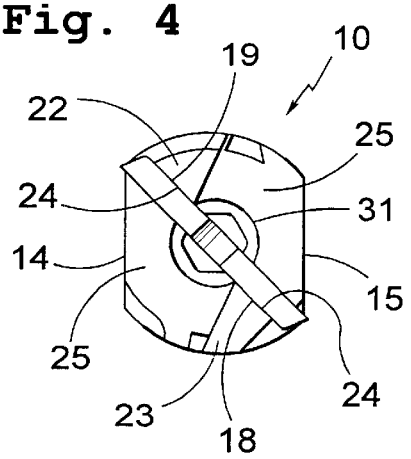
FIG. 4 is a front end view of the roof bolt depicted in FIG. 1.
Figure 5:
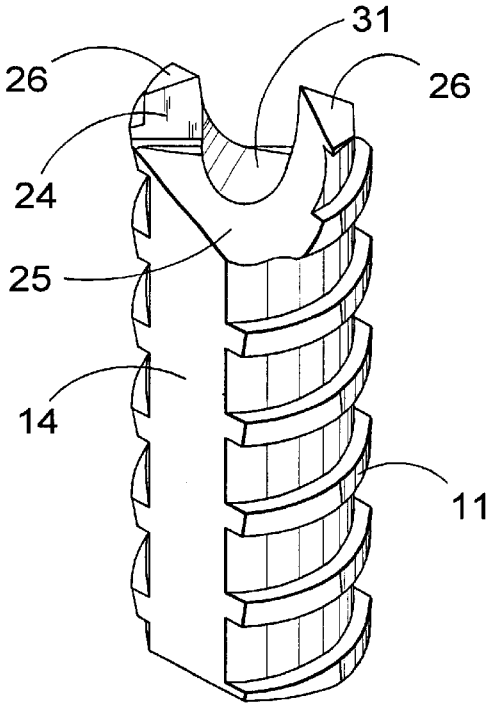
FIG. 5 is a view similar to FIG. 1 with the drill tip removed therefrom.
Figure 6:
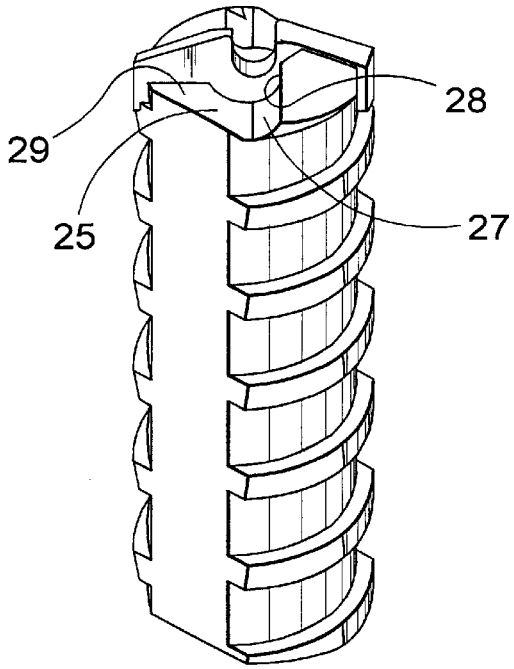
FIG. 6 shows a roof bolt having a modified form of body according to the invention.
Figure 7:
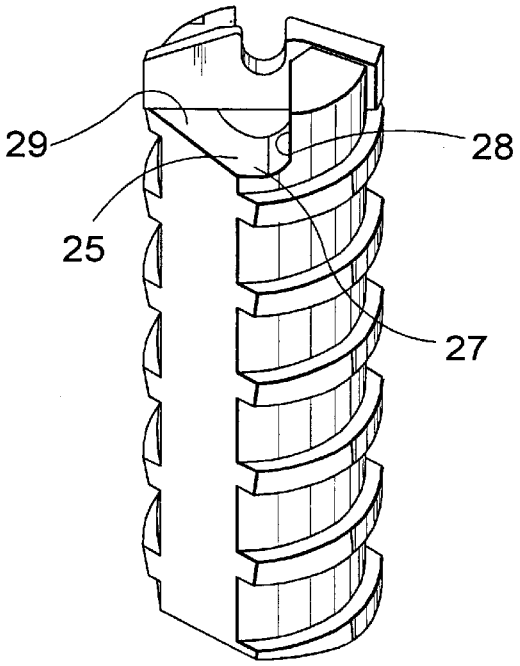
FIG. 7 is a view similar to FIG. 6 showing yet a different embodiment of a body.

The planar faces 18 and 19 of the drill tip 17 extend into abutting engagement with a pair of axially extending abutment elements or wings 22 and 23 of the bolt body. The abutment elements 22 and 23 are machined to engage flush against the respective planar faces 18 and 19 of the drill tip 17, Thus, the elements each include a planar face 24 for that purpose. FIG. 5 shows the roof bolt 10 with the drill tip 17 removed, and the planar faces 24 are more clearly evident from that figure. In the plan view of FIG. 4, the elements 22 and 23 are shown to be generally triangular and to extend to faces 25 of the bolt body that are machined in a curved (i.e., U-shaped as viewed in FIG. 5) or scalloped manner. The faces 25 are machined in a scalloped manner to provide frontal clearance for the drill tip 17. The degree of frontal clearance can vary and FIGS. 6 and 7 show different profiles that have the same clearance purpose. In each of FIGS. 6 and 7, the face 25 includes a curved section 27 extending between two linear sections 28 and 29. Other profiles can equally be adopted.

The end faces 26 of the elements 22 and 23 (see FIG. 5) are inclined downwardly in the same direction as the cutting edges 20 of the drill tip 17 to provide cutting clearance behind the drill tip, That clearance permits the drill tip to move forward into the rock surface being drilled without the abutment elements 22 and 23 engaging that surface and hindering forward movement.

Figure 2:
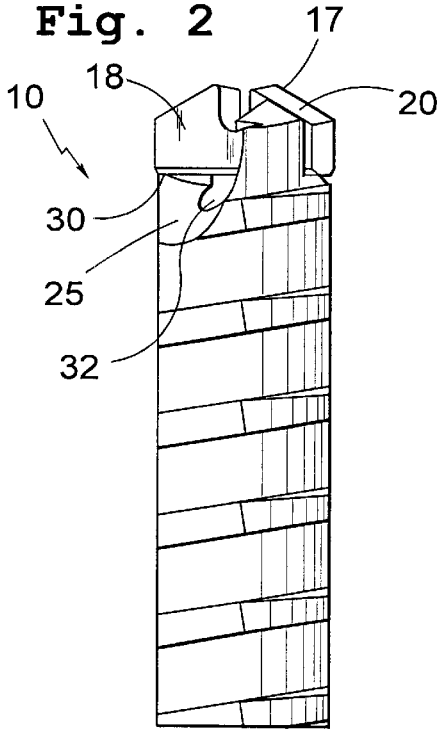
FIG. 2 is a side elevational view of the roof bolt depicted in FIG. 1.
Figure 3:
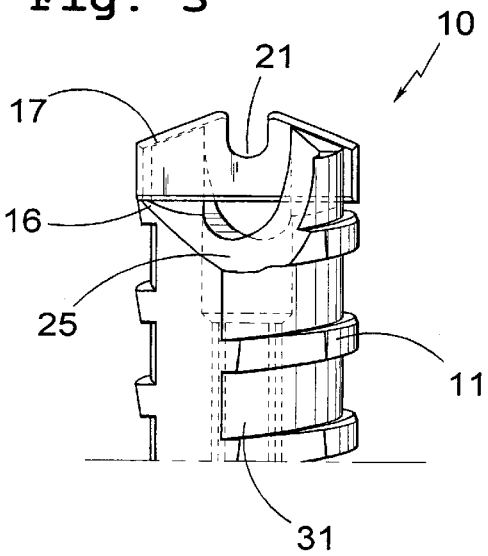
FIG. 3 is a fragmentary side elevational view of the roof bolt taken from a different angle than plane 2.

As shown in FIG. 2, the face 25 intersects the central bore 31, further exposing the open end 32 of the bore 31. This also enhances flushing fluid speed and glue pumping speed.

The bore 31 may have a diameter which is equal to the diameter of the bore of the rod as formed prior to machining the leading end 16 thereof, or it may be enlarged as necessary. Preferably the bore 31 is enlarged, and this may be achieved by drilling out the original rod bore. The bore maybe enlarged for the full lengthwise extent of the rod, or for only a portion thereof, such as at the leading end only.

The leading end of the rod 10 is furthermore machined in a manner that supports the drill tip 17 axially against axial drilling forces imparted on the cutting edges 20 during drilling. The support surface 30 shown in FIG. 2 forms a supporting platform to support the drill tip 17 along the rear or bottom surface thereof. The extent of axial support can vary from the outer peripheral edge of the rod to the inner edge of the central bore 31, or can be a lesser amount as may be acceptable. In this respect, drill tips are generally quite brittle and maximum support is desirable, although not necessarily essential The drill tip 17 is thus supported both axially and rotationally and is connected to the leading end of the roof bolt generally by brazing. Most importantly, in the roof bolt of the invention, it is not necessary to employ a separate drill bit as in known self-drilling roof bolts, so that the expense of installing the bolt is considerably reduced.

Figure 8:
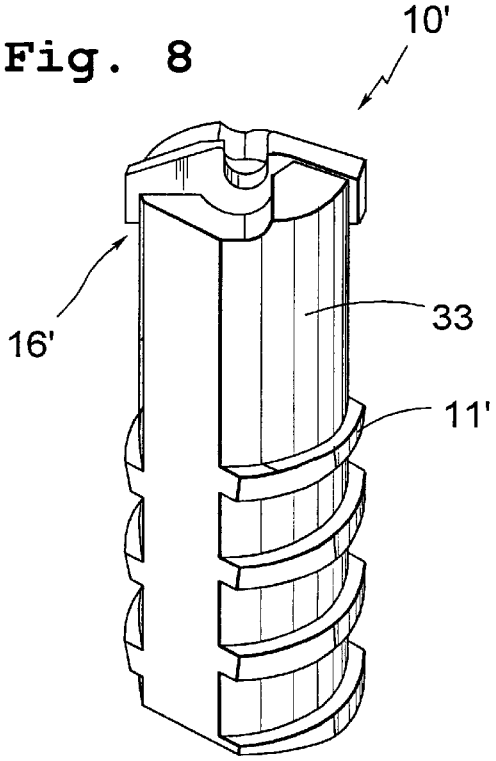
FIG. 8 is a view similar to FIG. 6 showing still another form of body.

FIG. 8 shows a still further embodiment of the invention, in which the thread 11' is terminated well before the leading end 16' of the bolt 10'. The unthreaded section 33 of the bolt 10' further enhances flushing and glue pumping speed, by reducing resistance to flow.

FIGS. 9 to 16 show a roof bolt 100 which is principally arranged for percussive drilling. The roof bolt 100 includes a pair of spaced apart abutment elements 101 and 102 which define a recess 103 for accommodating a drill tip 104. The drill tip is a percussive drill tip, which is shaped to have a chisel-like form, as opposed to a cutting edge of the kind shown in FIGS. 1 to 8.

Figure 9:
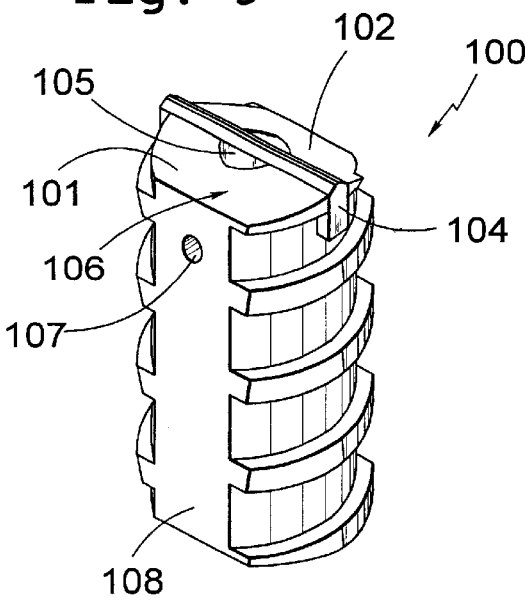
FIG. 9 is a front perspective view of a form of the invention used for percussive type drilling.
Figure 10:
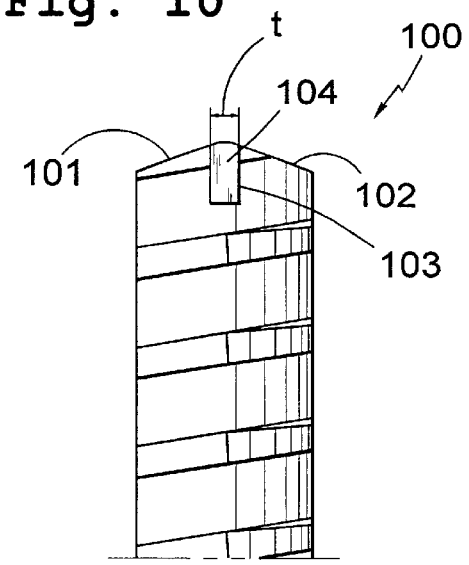
FIG. 10 is a side elevational view of the roof bolt depicted in FIG. 9.
Figure 11:
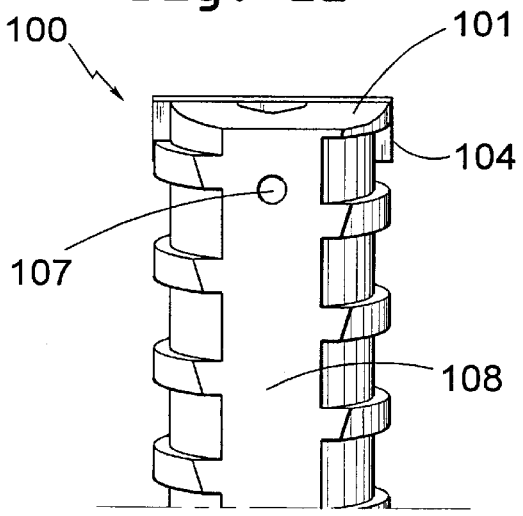
FIG. 11 is a side elevational view of the roof bolt depicted in FIG. 10 taken in a direction oriented 90° with respect to FIG. 10.
Figure 12:
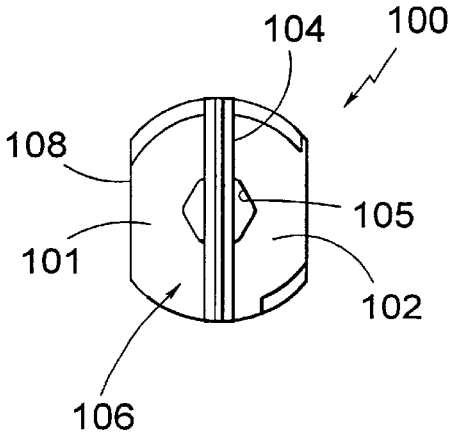
FIG. 12 is a front view of the roof bolt depicted in FIG. 9.
Figure 13:
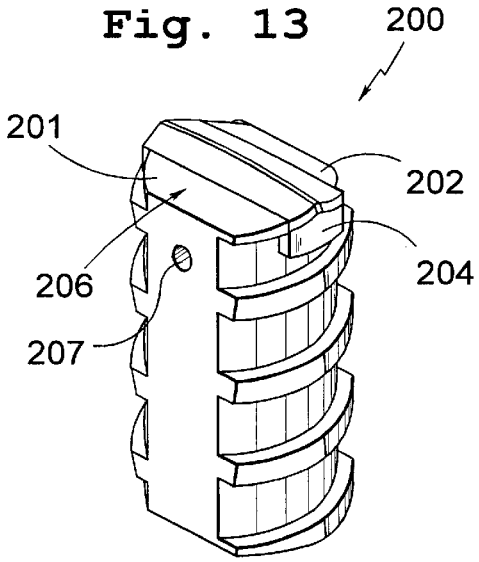
FIG. 13 is a front perspective view of another form of roof bolt adapted for percussive drilling according to the invention.
Figure 14:
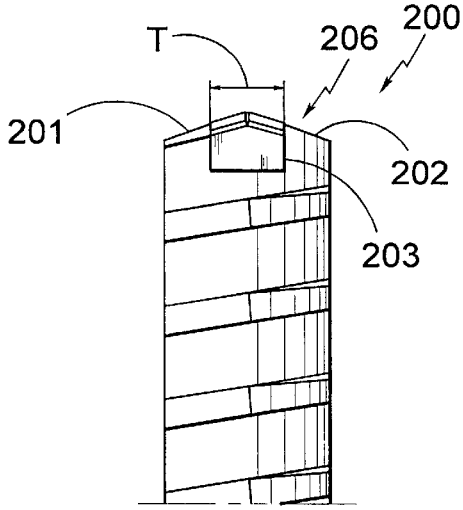
FIG. 14 is a side elevational view of the roof bolt depicted in FIG. 13.
Figure 15:
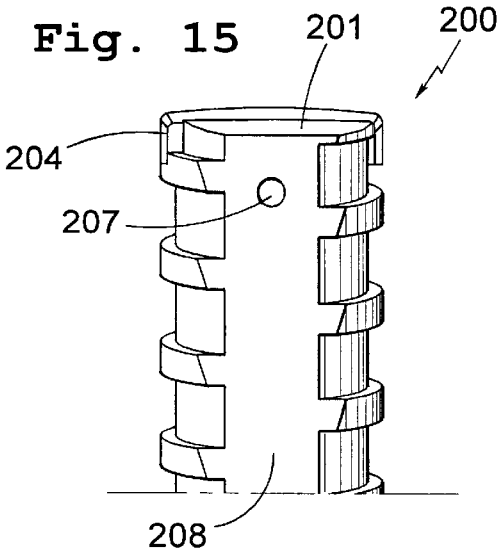
FIG. 15 is a side elevational view of the roof bolt depicted in FIG. 14 taken in a direction offset by 90° from that of FIG. 14.
Figure 16:
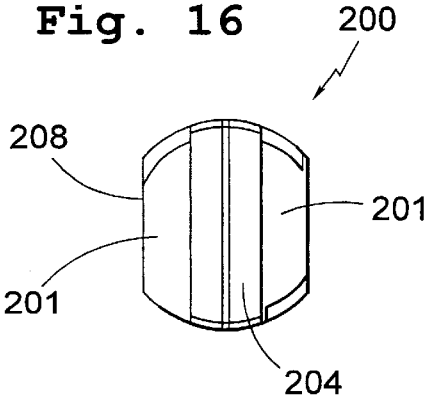
FIG. 16 is a front end view of the roof bolt depicted in FIG. 13.

The roof bolt 100 operates in a similar manner to the roof bolt 10 of FIGS. 1 to 8 and thus is arranged to have the central bore 105 open at the leading end 106 as shown in FIGS. 9 and 12. Additionally however, the roof bolt 100 includes a lateral branching conduit 107 which extends laterally to the central bore 105 and opens out of the flat surface 108.

The roof bolt 200 shown in FIGS. 13 to 16 includes many of the features shown in the roof bolt 100, and therefore, like parts will be identified by the same reference numeral one hundred. The drill tip 204 has a greater thickness T than the thickness t of the tip 104 shown in FIG. 10. Because of that thickness T (which is greater than the diameter of the central bore), the central bore is not able to be open at the leading end 206. Thus, the main difference between the roof bolts 100 and 200, is that the drill tip 204 extends over and fully covers the open end of the central bore at the leading end 206 thereof. The roof bolt 200 does however, include at least one branching conduit 207 that extends laterally from the central bore and therefore opens the central bore into the flat surface 208 adjacent the leading edge 206.

The invention described herein is susceptible to variations, modifications and/or additions other than those specifically described and it is to be understood that the invention includes all such variations, modifications and/or additions which fall within the spirit and scope of the above description.

What is claimed is:

1. An elongate roof bolt comprising a bolt body and a drill tip attached thereto, the bolt body having an axially extending central bore and defining a leading end; said leading end including a pair of axially extending machined abutment elements, the abutment elements including respective abutment faces arranged for engagement with respective opposite sides of the drill tip to transmit rotary forces to the drill tip during drilling, said drill tip extending across said leading end and being bonded to the abutment elements, said bore opening out of said bolt adjacent said leading end.

2. An elongate roof bolt according to claim 1, wherein said drill tip has a thickness which is less than a width of the central bore wherein said central bore opens at said leading end of said body on at least one side of said drill tip.

3. An elongate roof bolt according to claim 2, wherein said drill tip extends across said leading end centrally of said central bore, so that said bore opens at said leading end substantially equally on both sides of said drill tip.

4. An elongate roof bolt according to claim 1, wherein said bolt body further includes at least one branching conduit extending from said central bore and opens adjacent said leading end of said bolt body.

5. An elongate roof bolt according to claim 1, wherein said drill tip has a thickness greater than a width of said central bore to close said central bore at said leading end of said bolt body, said central bore opening adjacent said leading end through one or more branching conduits extending from said central bore.

6. An elongate roof bolt according to claim 1, wherein said abutment elements support each said side of said drill tip along substantially a full length of said drill tip extending across said leading end of said body.

7. An elongate roof bolt according to claim 1, wherein said abutment elements are disposed on opposite sides of said drill tip and support said tip only at opposite end portions of said drill tip.

8. An elongate roof bolt according to claim 1, wherein said drill tip is supported along at least a portion of a base surface thereof against a machined planar surface of said leading end of said bolt body.

9. An elongate roof bolt according to claim 8, wherein said planar surface is formed on a platform machined into said leading end of said bolt body.

10. An elongate roof bolt according to claim 8, wherein said planar surface extends from opposite edges of said central bore to outer edges of said leading end of said bolt body.

11. An elongate roof bolt according to claim 1, wherein said roof bolt includes a screw thread extending along an outer surface of the bolt body, the thread terminating adjacent said leading end of said bolt body.

12. An elongate roof bolt according to claim 1, wherein a clearance space is provided in said leading end on at least one side of said drill tip adjacent a respective abutment element, to expose a portion of at least one side face of said drill tip.

13. An elongate roof bolt according to claim 12, wherein said leading end of said bolt body is shaped to extend axially rearwardly from at least one of said abutment elements to provide said clearance space.

14. An elongate roof bolt according to claim 13, wherein said leading end is shaped to provide said clearance space from one side edge of said drill tip to said abutment element.

15. An elongate roof bolt according to claim 14, wherein a profile of said clearance space is curved from a minimum depth located adjacent an outer edge of said leading end of said base body to a maximum depth located adjacent a portion of said drill tip situated adjacent a mid section of said base body.

* * * * *